United States Patent [19]

Durbin et al.

[11] Patent Number: 4,904,212

[45] Date of Patent: Feb. 27, 1990

[54] ELECTRICAL CONNECTOR ASSEMBLY

[75] Inventors: Roger W. Durbin, Lancaster; Mark P. Hoffecker, Dillsburg; John P. Kling, Mount Joy; Brian W. Vernau, Harrisburg, all of Pa.

[73] Assignee: AMP Incorporated, Harrisburg, Pa.

[21] Appl. No.: 239,100

[22] Filed: Aug. 31, 1988

[51] Int. Cl.[4] ..... H01R 13/42

[52] U.S. Cl. ..... 439/751; 439/82; 29/845

[58] Field of Search ..... 439/82, 84, 290, 751, 439/857; 29/837, 838, 845

[56] References Cited

U.S. PATENT DOCUMENTS

| | | | |
|---|---|---|---|
| 3,208,030 | 9/1965 | Evans et al. . | |
| 4,083,101 | 4/1978 | Coller . | |
| 4,186,982 | 2/1980 | Cobaugh et al. . | |
| 4,286,837 | 9/1981 | Yasutake et al. | 439/82 X |
| 4,380,118 | 4/1983 | Driver et al. . | |
| 4,383,361 | 5/1983 | Kautz . | |
| 4,394,795 | 7/1983 | Goss . | |
| 4,553,322 | 11/1985 | Cappos et al. . | |
| 4,555,847 | 12/1985 | Dornes et al. . | |
| 4,573,262 | 3/1986 | Dornes et al. . | |
| 4,590,673 | 2/1986 | Dornes et al. . | |

FOREIGN PATENT DOCUMENTS

| | | | |
|---|---|---|---|
| 0271357 | 6/1988 | European Pat. Off. | 439/82 |
| 2093641 | 9/1982 | United Kingdom | 439/751 |

OTHER PUBLICATIONS

"Improved Serpentine Connector Assembly", IBM Tech. Discl. Bull. vol. 31, No. 7, pp. 425–426, Dec. 1988.

*Primary Examiner*—Eugene F. Desmond
*Attorney, Agent, or Firm*—Katherine A. Nelson

[57] ABSTRACT

An electrical connector assembly (20) has a plurality of compliant pin terminals (28) inserted into a "header" or insulated connector housing member (22) by a force exerted directly on an end portion (32) of each compliant pin terminal (28). Each compliant pin terminal (28) carries a contact portion (40), which is laterally offset with respect to the compliant pin terminal (28), so as not to interfere with the direct engagement of the compliant pin terminal (28) by a tool (46). The tool (46), which is driven by a suitable ram or press, is guided within a cavity (48) in the housing member (22).

19 Claims, 3 Drawing Sheets

ELECTRICAL CONNECTOR ASSEMBLYcl FIELD OF THE INVENTION

The present invention relates to an electrical connector assembly, and more particularly, to an electrical connector assembly having a plurality of compliant pin terminals, each of which carries a contact portion not adapted to be engaged by an insertion tool nor capable of sustaining substantial levels of force required for insertion thereof into circuit boards or panels.

BACKGROUND OF THE INVENTION

It is often desirable to electrically interconnect contact terminals in an electrical connector assembly to circuits on a circuit board or panel by means other than solder. One such means is the use of compliant pin terminals such as those disclosed in U. S. Pat. No. 4,186,982. Insertion of such terminals into a circuit board, however, requires the application of a sufficient amount of axial force to overcome the normal force between the split sections of the compliant pin and a plated through-hole thereby allowing the compliant pin portions to move through the plated through hole and establish electrical contact. Typically each compliant pin terminal requires approximately forty pounds of axial force to insert the terminal into the circuit board. Owing to the high insertion force, compliant pin terminals have generally been limited to square post terminals that are sufficiently strong to withstand the level of force required to insert the terminal into the board.

In some applications, however, it is desirable that the electrical terminals in the electrical connector assemblies include compliant pin portions having contact portions with a more complex structure than square posts. The configuration of such contact members may be quite varied, but generally they are stamped and formed members of relatively light gauge metal. As such, the contact portions or members members are not adapted to be engaged by insertion tools nor capable of sustaining substantial levels of force required for insertion thereof into their respective housings or into circuit boards where insertion would encounter substantial resistance.

For purposes of illustrating the invention, the contact portion is shown as a serpentine type contact member. It is to be understood, however, that the contact portion is not limited to the serpentine structure and that the profile of the contact portion may have many different shapes. Serpentine type contacts or terminals in electrical connectors are well known in the art, as represented by U.S. Letters Pat. No. 3,208,030. These serpentine contacts comprise a relatively-thin flexible strip of metal, at least a portion of which may be plated, which is folded back upon itself several times to form a continuous "bellows" or "serpent" contact. The serpentine contact has an end portion thereof formed as a spring finger or latch that cooperates with an internal ledge formed within an insulated connector housing member that houses the serpentine contact; and the spring latch may be manually depressed, using a suitable tool, in order to remove the serpentine contact from its insulated housing member. The serpentine contact as disclosed in the above patent is generally used with solder connections or for crimping to wire members. Additionally, these serpentine contacts are hermaphroditic, so that a plurality of serpentine contacts in a first connector may matingly engage a corresponding plurality of similar serpentine contacts carried by a complementary second connector.

For some applications, it is desirable that the serpentine contacts be securable to a compliant pin terminal (or compliant pin terminal post) which is an elongated terminal adapted to be received with an interference fit (for example) within a plated opening formed in a circuit board; and the circuit board, for example, may constitute a backplane of a computer apparatus. When the serpentine contact is carried by the compliant pin terminal, the serpentine contact interferes with a direct engagement of the compliant pin terminal by an insertion tool such as a push rod (or other tool) carried by a ram-type of press.

The prior art is further represented by U.S. Letters Pat. No. 4,553,322, wherein the push pins carried by the ram tool enter terminal-containing passageways of a connector and extend through socket portions of the terminals to engage push surfaces of the respective terminals, pushing the terminal post portions into respective holes of a circuit board.

SUMMARY OF THE INVENTION

Accordingly, it is an object of the present invention to provide an electrical connector assembly having a plurality of compliant pin terminals carrying respective serpentine contacts, wherein the ram tool pushes directly on the compliant pin terminals (without interference from the respective serpentine contacts) to insert the compliant pin terminals into respective passageways of an insulated connector housing and the respective compliant pin terminals into corresponding through-holes in a circuit board or panel.

It is another object of the present invention to provide a means to remove and replace an individual contact member without the need to remove the entire connector assembly from the board.

It is another object of the present invention to facilitate economical automated (or semi-automated) manufacture of an electrical connector assembly, wherein the assembly has a plurality of compliant pin terminals preferably carrying respective serpentine contacts.

In accordance with the teachings of the present invention, there is herein illustrated and described, a preferred embodiment of an electrical connector assembly including a "header" or insulated housing member having first and second side portions. The housing member further has at least one passageway formed therein between the first and second side portions thereof. A compliant pin terminal is carried in the passageway in the housing member, and the compliant pin terminal has first and second end portions thereof. A serpentine contact is disposed in the housing member and is secured to the compliant pin terminal intermediately of the first and second end portions of the compliant pin terminal. The serpentine contact is laterally offset from the second end portion of the compliant pin terminal, such that the second end portion of the compliant pin terminal is accessible from externally of the second side portion of the housing member. With this arrangement, a tool may be used to push against the second end portion of the compliant pin terminal directly and without interference from the serpentine contact, thereby securing the compliant pin terminal, and the serpentine contact attached thereto, within the housing member and the circuit board.

In accordance with the further teachings of the present invention, there is disclosed an improved method of inserting a compliant pin terminal and a serpentine contact subassembly into an insulated connector housing member and into a circuit board. The improved method includes the step of securing the serpentine contact to the compliant pin terminal, such that the serpentine contact is laterally offset from the compliant pin terminal, thereby providing access to an end portion of the compliant pin terminal. The housing member has an passageway formed therein, and the housing member further has a recess formed therein offset laterally from the passageway in the housing member, permitting a force or push to be exerted against one end portion of the compliant pin terminal without interference from the serpentine contact. With this arrangement, the compliant pin terminal is received in the passageway in the housing member by a force fit, with the serpentine contact being received in the laterally-offset recess in the housing member. The assembled connector is then mounted to a circuit board by means of an insertion tool, which pushes against the end of the compliant pin portion and a stop ledge within the housing member.

To remove the compliant pin terminal from the circuit board and/or housing member, a lesser force is exerted on the other end portion of the pin, and in an opposite direction. Individual terminals may be removed from the board and housing without disturbing the remaining terminals in the electrical connector assembly.

These and other objects of the present invention will become apparent from a reading of the following specification, taken in conjunction with the enclosed drawings.

DETAILED DESCRIPTION OF THE PREFERRED EMBODIMENTS

Figure 1:
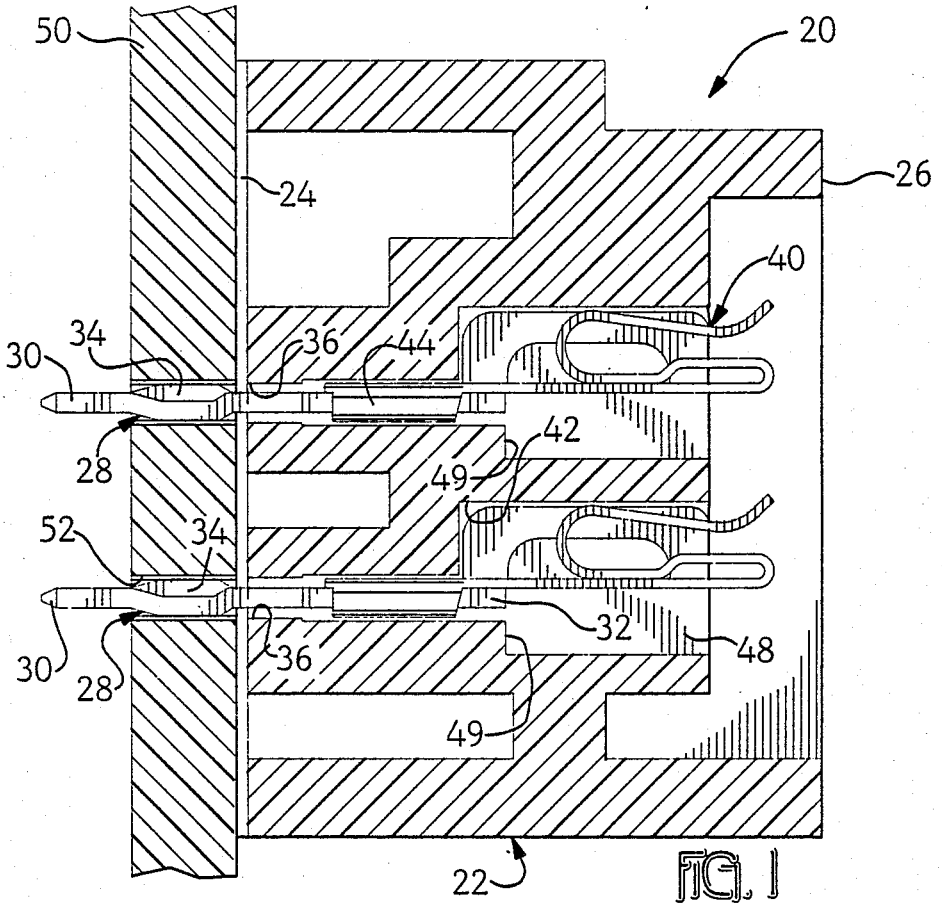
FIG. 1 is a longitudinal cross-sectional view of an electrical connector assembly of the invention mounted to a circuit board, the assembly including an insulated housing member having a plurality of contact members comprising compliant pin terminal portions each carrying respective off-set contact portions, the contact members being shown in elevation for ease of illustration.
Figure 2:
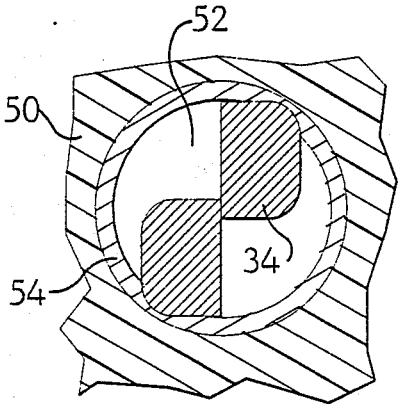
FIG. 2 is an enlarged cross-sectional view of the compliant pin terminal portion, taken along the lines 2—2 of FIG. 1 and showing a detail of the compliant pin terminal portion in a plated through-hole of the circuit board.

With reference to FIGS. 1 and 2, the electrical connector assembly 20 includes an insulated connector housing member 22 having (generally) a first side portion 24 and a second side portion 26 and a plurality of electrical contact terminals having a compliant pin terminal 28 and a contact portion 40. For purposes of illustration, contact portion 40 is shown as a serpentine type contact member. It is to be understood, however, that the contact portion is not limited to the serpentine structure and that the profile of the contact portion may have many different shapes. The serpentine contact is used to represent those types of contact structures that are not adapted to be engaged by an insertion tool nor capable of sustaining substantial levels of force required for insertion thereof into connector housings and/or insertion into circuit boards or panels where insertion would encounter substantial resistance. The connector housing member 22 is adapted to be mated with a complementary connector within an electrical or electronic apparatus. The housing member 22 carries a plurality of posts or "compliant pin terminals" 28 adapted to be received within plated through-holes of a circuit board without the need for solder. The circuit board may be part of a "backplane" of a computer.

With this in mind, each compliant pin terminal 28 has a first end portion 30, a second end portion 32, and an enlarged compliant portion 34. The enlarged portion 34 of the compliant pin terminal 28 is adapted to be received within the respective plated opening 52 of the circuit board 50, as shown in FIG. 2. Edges of portion 34 engage plated layer 54 of through-hole 52 to establish electrical connection therewith. As can be seen in FIG. 2, plated through-hole 52 is somewhat distorted by portion 34 as force is applied to insert compliant portion 34. The compliant pin terminal 28 is received in a passageway 36 formed in the housing member 22; and the compliant pin terminal 28 is retained in the passageway 36 by one or more projections 38, as shown more clearly in FIG. 3. Preferably, the passageway 36 is a through passageway which communicates the first and second side portions 24 and 26, respectively, of the housing member 22; and the first end portion 30 of the compliant pin terminal 28 (with its enlarged portion 34) extends beyond the first side portion 24 of the housing member 22, as shown more clearly in FIG. 1, for engagement in through-hole 52 of circuit board 50.

A serpentine contact 40 is secured to each compliant pin terminal 28 and is disposed laterally offset therefrom, as shown more clearly in FIG. 1, so that the second end portion 32 of the compliant pin terminal 28 is disposed intermediate the first and second side portions 24, 26 of housing member 22 and is accessible externally of the second side portion 26 of the housing member 22 without interference from the serpentine contact 40. The serpentine contact 40 comprises a relatively-thin metallic strip which is bent back upon itself, as shown more clearly in FIG. 1, to form a "bellows" or "serpent" configuration which is disposed within a recess 42 formed in the housing member 22. The recess 42 is laterally offset from the through passageway 36 in the housing member 22.

Figure 3:
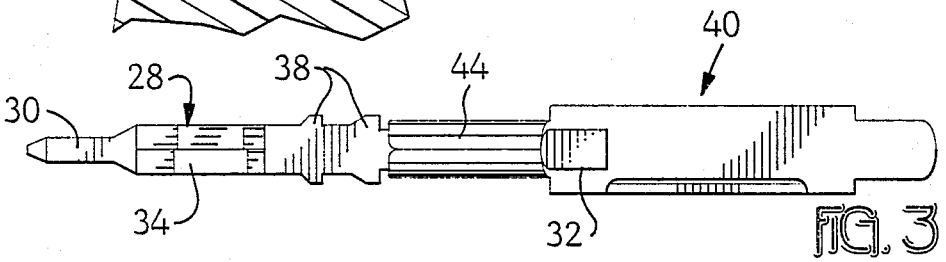
FIG. 3 is a plan view of the contact member of FIG. 1 showing further details of the present invention.

Preferably, the serpentine contact 40 is secured to the compliant pin terminal 28 (intermediately of its first and second end portions, 30 and 32, respectively) by a "barrel" crimp 44 shown more clearly in FIGS. 1 and 3. Alternatively the serpentine contact may be secured by brazing, welding, or the like, or may be of one piece construction.

Figure 5:
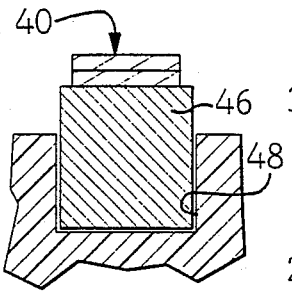
FIG. 5 is a cross-sectional view of the connector assembly, taken across the lines 5—5 of FIG. 4, and showing the complementary cross-sections between the ram-actuated tool and the cavity in the housing member for slidably guiding the tool into the housing member.
Figure 4:
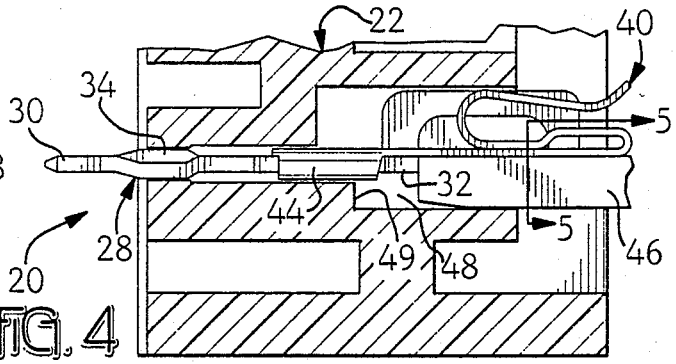
FIG. 4 is a cross-sectional view of the connector assembly showing the manner in which a press or ram-actuated tool pushes directly against an end portion of the compliant pin terminal to thereby insert the compliant pin terminal portion (and its respective off-set contact portion) within the housing member, the tool being guided within a cavity formed in the housing member.

With reference to FIGS. 4 and 5, the method of inserting the respective compliant pin terminals 28 within the housing member 22 will be more readily appreciated. The second end portion 32 of each pin 28 is accessible (externally) of the second side portion 26 of the housing member 22 and thus may be engaged by a suitable tool 46. The tool 46 engages the end 32 of compliant pin terminals 28 directly, without any interference from the respective serpentine contact 40, since the serpentine contact 40 is lodged in its respective recess 42 in the housing member 22 (laterally offset with respect to the compliant pin terminal 28). The tool 46 (which is illustrated schematically in FIGS. 4 and 5) is actuated by a suitable ram or press, which may be manual or power operated, such as by a hydraulic press. The press is conventional, however, and hence has been omitted for ease of illustration. Preferably a plurality of terminals are inserted by the tool in an automated or semiautomated process. It is to be understood, however, that the terminals may be inserted one at a time.

Figure 6:
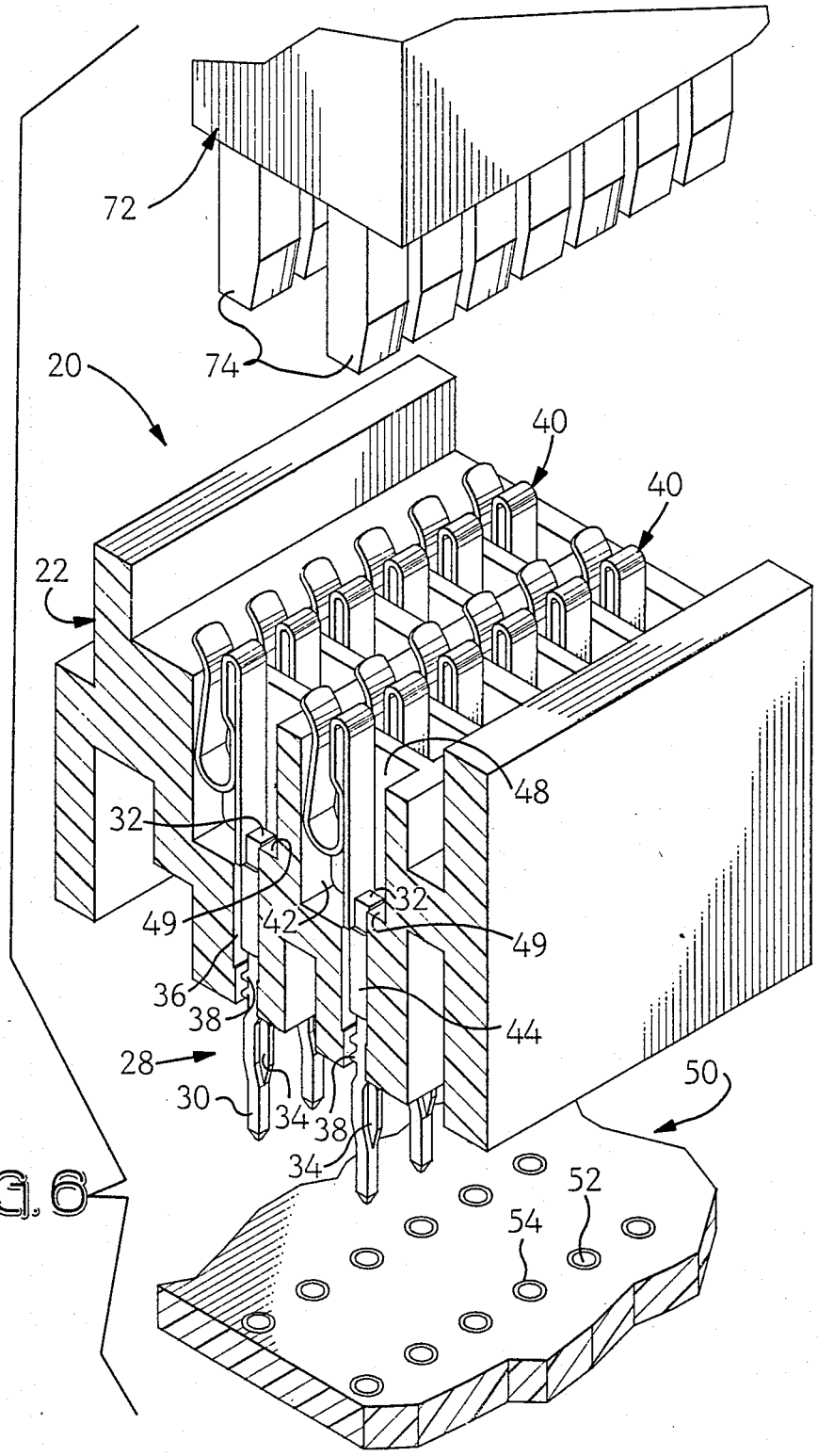
FIG. 6 is an exploded perspective view, illustrating (schematically) a preferred form of production tooling, comprising a "comb" with "fingers" for mounting the connector assembly having a plurality of respective compliant pin terminal portions therein being mounted to a circuit board.

Preferably, the tool 46 is slidably guided or piloted in a cavity 48 formed in the housing member 22; and for this purpose, the tool 46 and its respective cavity 48 have complementary cross-sectional configurations, which may be substantially square as shown more clearly in FIG. 5. Terminals 28 including contact portion 40 attached thereto are fully inserted into housing member 22 by inserting tool 46 into recess 48 and against end 32 of terminal 28 until the tool 46 reaches stop ledge 49 inside recess 48. Terminal members 28 are held in respective passageways 36 by projections 38. The axial force required to force fit the terminal members 28 into housing member 22 is considerably less than the axial force required to mount the terminals to the board 50. Stop ledge 49 further provides an internal housing surface for engaging the end surfaces of insertion fingers 74 of mounting tooling 72 when the connector assembly 20 is mounted to circuit board 50 as shown in FIG. 6. In a preferred embodiment, the axial force required on the tool 72 to insert the compliant pin terminals 28 of connector assembly 20 into respective through-holes 52 is approximately forty pounds per terminal.

Figure 7:
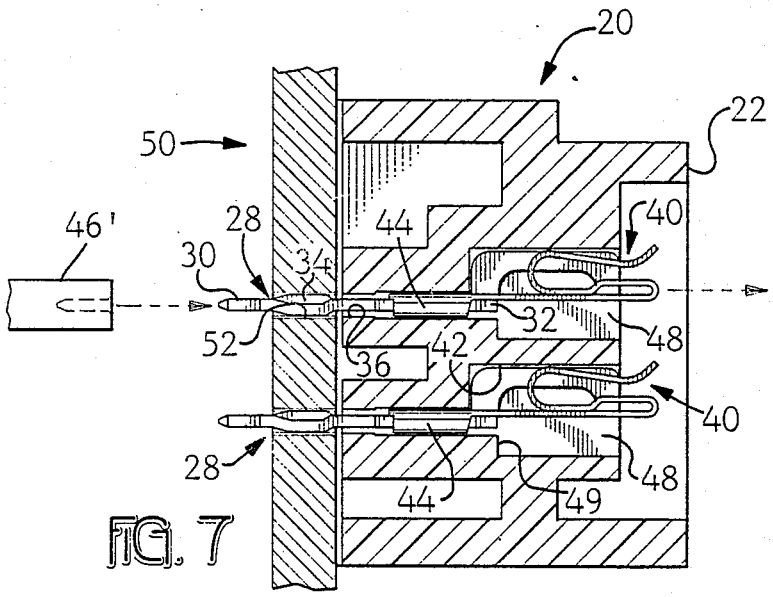
FIG. 7 illustrates the manner in which one of the compliant pin terminal portions (and its associated contact portion) may be selectively removed from the circuit board and the insulated housing member by exerting a direct (and lesser) force on the compliant pin terminal portion from the opposite direction.

To remove a respective compliant pin terminal 28 from through-hole 52 of the circuit board 50 and its respective passageway 36 in the housing member 22, a force is exerted by a tool 46' on the compliant pin terminal 28 in the opposite direction, that is, from the side of circuit board 50 that is opposite the connector assembly 20, as shown more clearly FIG. 7, thereby overcoming the resistance of the through-hole 52 and the lesser resistance of projections 38 in housing member 22. Thus, an individual compliant pin terminal 28 may be removed easily and conveniently from the board and/or the housing member (or header) 22 for replacement purposes — rather than attempting to remove all of the pins or otherwise servicing the entire housing member 22 — and this is another important feature and advantage of the present invention.

With reference to FIG. 4, and as previously described, the housing member (or header) 22 may contain a plurality of compliant pin terminals 28 and to insert or ("stitch" ) all of the compliant pin terminals 28 into the housing member 22, a plurality of tools 46 will be required. In actual practice, these tools 46 may resemble "teeth" on a "comb", and is similar in shape to the tooling 72 shown schematically in FIG. 6.

All of the pins 28 may be pushed in at the same time (either by a hand press or a hydraulic press) and, as previously noted, the typical axially applied insertion force is approximately forty pounds per pin. The tool pushes on the pins 28 directly and on stop ledge 49 of the connector housing member not on the respective contact portions. Thus the pins 28 (with their serpentine contacts 40) are pushed in from the front and can be separately replaced without removing the entire connector. The serpentine contact 40 is laterally offset from its respective compliant pin terminal 28, so as not to interfere with the direct engagement, that is, pushing directly against the compliant pin terminals 28. This method provides a solderless attachment of the serpentine contacts 40 to circuit boards and provides a cost effective method for providing compliant pin terminal portions for complex contact members. Moreover, a resilient "latch" is no longer required on the serpentine contact 40, and the barrel crimp 44 to the compliant pin terminal (or post) 28 is offset, thereby accommodating the direct engagement between the tool 46 and the compliant pin terminal 28 as the compliant pin terminal 28 is inserted into the housing member 22.

Figure 8:
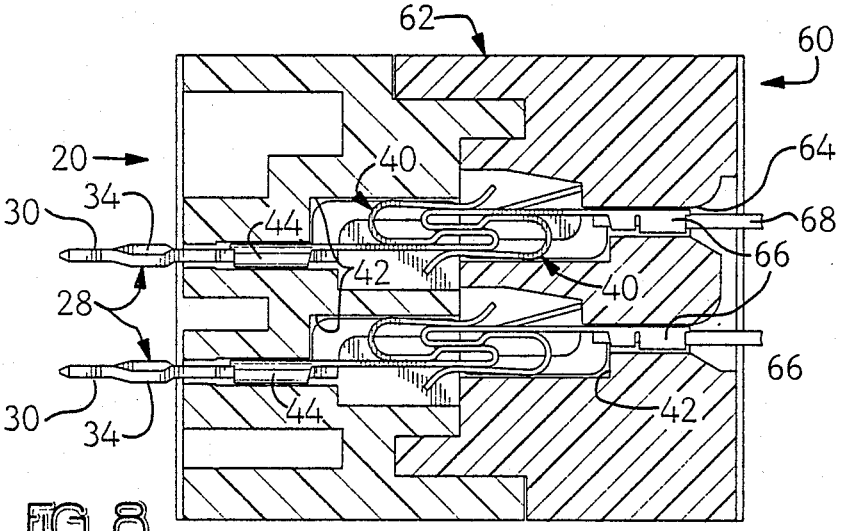
FIG. 8 illustrates a connector assembly of the present invention mated with a complementary assembly.

With reference to FIG. 8, a second connector assembly 60 having a complementary mating face may be mated for engagement with the (first) connector assembly 20, as the respective serpentine contact portions 40 nest within each other. Connector assembly 60 is shown with serpentine contact members 40 terminated at 66 to wire conductors 68 disposed in passageways 64 of housing member 62. For purposes of illustration the panel and the cable to which connector assemblies 20, 60 are attached respectively, are not shown.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An electrical connector assembly, comprising:

an insulated housing member having first and second side portions, the housing member further having at least one passageway formed therein between the first and second side portions of the housing member;

a compliant pin terminal carried in the passageway in the housing member, the compliant pin terminal having first and second end portions thereof; and an electrical contact portion disposed in the housing member and secured to the compliant pin terminal intermediately of the first and second end portions of the compliant pin terminal, the electrical contact portion being laterally offset from the second end portion of the compliant pin terminal, such that the second end portion of the compliant pin terminal is accessible from externally of the second side portion of the housing member, whereby a tool may be used to push against the second end portion of the compliant pin terminal directly without interference from the contact portion, thereby enabling the compliant pin terminal to be secured in the housing member and insertion force to be applied to the compliant pin portion without applying said insertion force to said contact portion.

2. The electrical connector assembly of claim 1, wherein the passageway in the housing member comprises a through passageway communicating the first and second side portions of the housing member; and wherein the first end portion of the pin extends through the first side portion of the housing member, whereby the compliant pin terminal may be received within a circuit board.

3. The electrical connector assembly of claim 2, wherein the housing member further includes means for stopping said tool when the compliant pin terminal has reached a predetermined location.

4. The electrical connector assembly of claim 3 wherein the housing member further includes means for receiving tooling means for mounting the assembly to a circuit board, the tooling means engaging the tool receiving means and the second end portion of the compliant pin terminal directly and without interference from the contact portion thereby enabling the assembly to be mounted to a circuit board without applying force to the contact portion.

5. The electrical connector assembly of claim 1, wherein the contact portion is secured to the compliant pin terminal by a barrel crimp.

6. The electrical connector of claim 1 wherein the contact portion is a serpentine contact member.

7. The electrical connector assembly of claim 1, wherein the housing member has a recess formed therein offset laterally from the passageway in the housing member, whereby the contact portion is disposed in the laterally-offset recess in the housing member.

8. The electrical connector assembly of claim 1, wherein the tool is actuated by a ram; and wherein the housing member has a cavity formed therein for piloting the tool, as the tool is pushed into the housing member past the second side portion thereof.

9. The electrical connector assembly of claim 8, wherein the tool and the cavity in the housing member have complementary respective cross-sections which are substantially square.

10. The electrical connector assembly of claim 1, wherein the second end portion of the compliant pin terminal is disposed within the housing member intermediately of the first and second side portions of the housing member.

11. The electrical connector assembly of claim 1, further including a plurality of compliant pin terminals and respective contacts portions carried thereby.

12. The electrical connector assembly of claim 11 mounted to a circuit board.

13. An electrical connector assembly, comprising:

a header including an insulated housing member having first and second side portions, the housing member further having a plurality of through passageways formed therein communicating the first and second side portions of the housing member;

the housing member further having a corresponding plurality of recesses formed therein, each recess being laterally offset from a respective through passageway in the housing member;

a plurality of compliant pin terminals carried in the respective through passageways in the housing member, each compliant pin terminal having first and second end portions thereof;

a corresponding plurality of contact portions, each of which is secured to a respective compliant pin terminal intermediately of the first and second end portions of the compliant pin terminal;

the contact portions being disposed in the respective laterally-offset recesses in the housing member, such that the respective second end portions of the compliant pin terminals are accessible from externally of the second side portion of the housing member;

whereby a tool comprising a plurality of respective fingers may be used to push against the respective second end portions of the compliant pin terminals without interference from the respective contact portions, thereby inserting the compliant pin terminals, and the contact portions secured thereto, within the housing member.

14. The electrical connector assembly of claim 13 wherein the housing member further includes stop means within respective passageways for stopping the tool when the terminal members have reached a predetermined location within their respective passageways.

15. The electrical connector assembly of claim 14 wherein the housing member further includes means for receiving tooling means for mounting the assembly to a circuit board, the tooling means engaging the tool receiving means and the second end portion of the compliant pin terminal directly and without interference from the contact portion thereby enabling the assembly to be mounted to a circuit board without applying force to the contact portion.

16. The electrical connector assembly of claim 13, wherein the housing member has a recess formed therein offset laterally from the passageway in the housing member, whereby the contact portion is disposed in the laterally recess in the housing member.

17. The electrical connector of claim 13 wherein the contact portion is a serpentine contact member.

18. A method of mounting an electrical connector assembly to a circuit board, said assembly comprising an insulated connector housing member having a plurality of compliant pin terminal and contact portion subassemblies disposed therein, the method comprising the steps of:

providing a plurality of subassemblies having the contact portion of each subassembly laterally offset from the compliant pin terminal, thereby providing access to an end portion of the compliant pin terminal;

providing said housing member with a plurality of subassembly receiving passageways, each passageway having a laterally offset recess associated therewith;

said subassemblies being disposed in said passageways of said housing member such that respective compliant pin terminals lie in said passageways and said contact portions lie within said corresponding associated offset recesses;

applying mounting force directly against the end portion of the compliant pin terminal without interference from the contact portion to insert the compliant pin terminals into respective through-holes of the circuit board, whereby the connector assembly is mounted to the circuit board and individual subassemblies may be removed from the board and the connector assembly without removing said assembly from said board.

19. A method of making a connector that is adapted to be mounted to a circuit board, comprising the steps of:

providing a plurality of terminal members, each terminal member having a compliant pin portion adapted to be force fit into a hole of a circuit board and for self retention therein, each said terminal members also including a contact portion laterally offset from the compliant pin portion thereby defining a push surface;

providing a housing member having a plurality of passageways formed therein and extending from a first face to a second face thereof, the housing member further having a plurality of recesses formed therein, each said recess extending inwardly from said first face and in communication with and laterally offset from an associated one of said passageways;

inserting said compliant pin portions into corresponding ones of said passageways from the first housing face with said offset contact portions aligned with said corresponding recesses; and pushing directly against said push surfaces of said compliant pin portions without interference from the corresponding contact portions thereby pushing said compliant pin portions through respective ones of said passageways and beyond said second housing face and locating said contact portions along corresponding ones of said recesses without the housing member;

whereby the compliant pin portions extend beyond the second housing face to be inserted into corresponding holes in said circuit board, said push surfaces of said terminal members being exposed to be engaged by pushing means of a tool when said terminal members in said housing member are simultaneously pushed into corresponding holes of said circuit board when the connector is mounted thereto.

* * * * *

UNITED STATES PATENT OFFICE

CERTIFICATE OF CORRECTION

Patent No. 4,904,212 Dated February 27, 1990

Inventor(s) Roger W. Durbin et al.

It is certified that error appears in the above-identified patent and that said Letters Patent is hereby corrected as shown below:

In the Claims:

Column 10, claim 19, Line 13 - the word "without" should be --within--.

Signed and Sealed this

Twenty-sixth Day of March, 1991

*Attest:*

HARRY F. MANBECK, JR.

*Attesting Officer*

*Commissioner of Patents and Trademarks*